US011807417B1

(12) United States Patent
Green

(10) Patent No.: US 11,807,417 B1
(45) Date of Patent: Nov. 7, 2023

(54) PALLET ASSEMBLY AND COMPONENTS THEREOF, AND METHODS OF MANUFACTURING AND USING THE SAME

(71) Applicant: G2 Composites, LLC, Georgetown, SC (US)

(72) Inventor: Guerry E. Green, Georgetown, SC (US)

(73) Assignee: G2 COMPOSITES, LLC., Georgetown, SC (US)

( * ) Notice: Subject to any disclaimer, the term of this patent is extended or adjusted under 35 U.S.C. 154(b) by 0 days.

(21) Appl. No.: 18/143,185

(22) Filed: May 4, 2023

(51) Int. Cl.
*B65D 19/00* (2006.01)

(52) U.S. Cl.
CPC ..... *B65D 19/0095* (2013.01); *B65D 2519/00273* (2013.01); *B65D 2519/00293* (2013.01); *B65D 2519/00323* (2013.01); *B65D 2519/00333* (2013.01); *B65D 2519/00442* (2013.01); *B65D 2519/00572* (2013.01)

(58) Field of Classification Search
CPC ..... B65D 19/0095; B65D 19/20; B65D 2519/00333; B65D 2519/00547
USPC ..... 108/56.1, 51.11, 51.3
See application file for complete search history.

(56) References Cited

U.S. PATENT DOCUMENTS 3,469,542 A * 9/1969 Ahlenius ..... B65D 19/0071 108/56.1
3,572,261 A * 3/1971 Vasilou ..... B65D 19/0095 108/56.1
4,077,334 A * 3/1978 Svirklys ..... B65D 19/0097 52/579
4,103,857 A 4/1978 Levenhagen
4,112,854 A * 9/1978 Pitchford ..... B65D 19/0095 108/57.32
4,841,880 A * 6/1989 Ferguson ..... B65D 19/0093 108/52.1
5,417,167 A * 5/1995 Sadr ..... B65D 19/0093 108/901
5,617,689 A * 4/1997 Beane ..... E04C 3/28 52/489.1
5,769,001 A 6/1998 Viessmann
(Continued)

FOREIGN PATENT DOCUMENTS

GB 2270298 A * 3/1994 ..... B65D 19/0012

*Primary Examiner* — Jose V Chen
(74) *Attorney, Agent, or Firm* — Bryan L. Baysinger; Maynard Nexsen PC

(57) ABSTRACT

Aspects of a pallet assembly are disclosed including two engagement stringers having a plurality of perpendicular stringers therebetween and engaged, end to end, to each engagement stringer, and one or more inert support surfaces supported thereby. The one or more support surfaces are a plurality of top slats supported and held directly by the frame comprising the stringers and the engagement stringers. The top slats include a structure that is complementary to a feature defined by the frame and that allows the top slats to mate with and be held by the frame. The pallet assembly demands fasteners for assembling the frame; however, in at least one aspect, the pallet assembly of the present disclosure also demands fasteners for attaching the top slats to the frame. In another aspect, the stringers and the engagement stringers each comprise one or more target inserts for reinforcing the frame of the pallet assembly.

13 Claims, 7 Drawing Sheets

(56) References Cited

U.S. PATENT DOCUMENTS

| | | | | |
|---|---|---|---|---|
| 6,155,181 | A * | 12/2000 | Chilcutt | B65D 19/0075 108/56.1 |
| 6,192,807 | B1 * | 2/2001 | Mason | B65D 19/0002 108/51.11 |
| 7,637,219 | B2 | 12/2009 | Hartel et al. | |
| 9,016,212 | B2 * | 4/2015 | Valiulis | G09F 23/06 229/87.01 |
| 9,546,019 | B2 | 1/2017 | Federl et al. | |
| 9,718,579 | B2 * | 8/2017 | Pisano | B65D 19/0095 |
| 2005/0247240 | A1 * | 11/2005 | Nelson | B65D 19/0012 108/51.3 |
| 2007/0245932 | A1 * | 10/2007 | Nielsen | B65D 19/0093 108/51.11 |
| 2008/0066657 | A1 * | 3/2008 | Kuo | B65D 19/0095 108/56.3 |
| 2008/0087203 | A1 | 4/2008 | Hartel et al. | |
| 2009/0211497 | A1 | 8/2009 | Koenes | |
| 2010/0175595 | A1 * | 7/2010 | Grietens | B65D 19/0095 108/51.3 |
| 2012/0298015 | A1 * | 11/2012 | Jian | B65D 19/0097 108/56.1 |
| 2013/0047897 | A1 | 2/2013 | Love | |
| 2013/0061784 | A1 | 3/2013 | Kessler | |
| 2016/0068302 | A1 | 3/2016 | Clark et al. | |
| 2017/0225826 | A1 * | 8/2017 | Xie | B65D 19/0095 |
| 2019/0092522 | A1 * | 3/2019 | Robinson | B65D 19/0026 |
| 2019/0177036 | A1 * | 6/2019 | Dominguez Guevara | B65D 19/0095 |

* cited by examiner

PALLET ASSEMBLY AND COMPONENTS THEREOF, AND METHODS OF MANUFACTURING AND USING THE SAME

FIELD

This disclosure relates to transport structures, pallets, or skids and components thereof, particularly, pallet assemblies comprised of recycled or virgin materials, that are designed for quick and efficient assembly, and for supporting goods in a stable fashion during transport from one destination to another destination.

BACKGROUND

A pallet (also called a skid) is a flat transport structure, which supports goods in a stable fashion while being lifted by a forklift, a pallet jack, a front loader, a jacking device, an erect crane, or any other piece of equipment for moving heavy or large objects.

A pallet is the structural foundation of a type of unit load and allows for handling and storage efficiencies. Goods in shipping containers are often placed on a pallet or other transport structure and secured with strapping, stretch-wrap, shrink-wrap, or equivalent. A unit load can be packed tightly into a warehouse rack, intermodal container, truck, boxcar, airplane, etc., yet can be easily broken apart at a distribution point, usually a distribution center, wholesaler, or retail store for sale to consumers or for use. Most consumer and industrial products move through the supply chain in a unit load for at least part of their transportation or distribution cycle. As such, unit loads make handling, storage, and distribution more efficient. They also help reduce handling costs and damage through bulk handling. About 2.0 billion unit loads are in daily use in the United States.

Pallets and other similar types of transport structures have dramatically supplanted older forms of transports structures like the wooden crate, box, or barrel. Pallets works well with modern packaging and transportation systems like corrugated boxes and intermodal containers commonly used for bulk shipping. In addition, pallet collars are commonly used to support and protect items shipped and stored on pallets. A typical pallet load might consist of corrugated fiberboard boxes stacked on a pallet or slip sheet and stabilized with stretch wrap, pressure-sensitive tape, strapping or shrink wrap.

While most pallets are wooden, pallets can also be made of plastic, metal, paper, and recycled materials. Wooden pallets typically include three or four stringers that support several deck boards or slats, on top of which the goods are placed, secured, and transported. In a pallet measurement, the first number is the stringer length and the second is the deck board or slat length.

Containerization for transport has spurred the use of pallets because shipping containers have the smooth, level surfaces needed for easy pallet movement and because pallets make it easier to move heavy stacks. Many pallets can handle a load of about 1,000.0 kilograms (kg) (about 2,200.0 pounds, lb.). Moreover, pallet loads can be hauled by forklift trucks of different sizes, or even by hand-pumped and hand-drawn pallet jacks. Some modern pallet standards are designed to allow the pallet load to pass through standard doorways.

The lack of a single international standard for pallets causes substantial continuing expense in international trade. A single standard is difficult because of the wide variety of needs a standard pallet would have to satisfy. However, due to the International Plant Protection Convention (IPPC), most pallets shipped across national borders must be made of materials that are incapable of being a carrier of invasive species of insects and plant diseases. Pallets made of raw, untreated wood for example are not considered phytosanitary complaint. To be compliant the pallets (or other wood packaging material) must meet debarked standards and must be treated by either of the following means under the supervision of an approved agency: the wood must be heated to achieve a minimum core temperature of about 56.0° C. (132.8° F.) for at least about 30.0 minutes; or the wood must be fumigated with methyl bromide, or other harsh chemicals.

SUMMARY

According to its major aspects and briefly recited, herein is disclosed a pallet assembly including a lineal engagement stringer, a lineal stringer, a lineal slat, and mechanical fasteners to securably fasten the first end of the lineal stringer to the lineal engagement stringer. The lineal engagement stringer has a profile comprising an internal space and a profile wall at least partially defining the internal space. The lineal stringer has a first end, a second end, a top wall defining a plurality of slots, and an internal screw boss. The lineal slat has a main wall and a leg configured to fit into a slot of the plurality of slots of the lineal stringer. Moreover, a portion of the main wall of the lineal slat is configured to sit on a portion of the top wall when the leg is pressed into the slot of the lineal stringer. Furthermore, the mechanical fastener traverses the profile wall of the lineal engagement stringer and engages with the internal screw boss of the lineal stringer. The lineal engagement stringer and/or the lineal stringer has one or more optional or non-optional target inserts that reinforce the lineal structure for loads and for lifting forces.

In some aspects, another pallet assembly is disclosed. The pallet assembly includes a lineal engagement stringer, a lineal stringer, a lineal slat, and mechanical fasteners to securably fasten the first end of the lineal stringer to the lineal engagement stringer. Each of the lineal engagement stringers and/or the lineal stringers includes one or more target inserts that reinforce the lineal structure for loads and for lifting forces. The lineal engagement stringer also has a profile comprising an internal space and a profile wall at least partially defining the internal space. The lineal stringer has a first end, a second end, a top wall defining a plurality of slots, and an internal screw boss. The lineal slat has a main wall and a leg configured to fit into a slot of the plurality of slots of the lineal stringer. Moreover, a portion of the main wall of the lineal slat is configured to sit on a portion of the top wall when the leg is pressed into the slot of the lineal stringer. Furthermore, the mechanical fastener traverses the profile wall of the lineal engagement stringer and engages with the internal screw boss of the lineal stringer.

In some aspects, a method of assembling a pallet is provided. The method includes providing a lineal engagement stringer, a lineal stringer, a lineal slat, and providing a mechanical fastener. The method also includes securably fastening a first end of the lineal stringer to the lineal engagement stringer and pressing a leg of the lineal slat into a slot of the lineal stringer such that a portion of a main wall of the lineal slat sits on the portion of the top wall of the lineal stringer. The method also includes using the pallet components by stacking or nesting and transporting them or the assembled pallet. The method also includes the optional or non-optional step of placing a target insert within the internal space of the lineal engagement stringer (and/or the lineal stringer which also has an internal space partially defined by a profile wall) via a target, for example, along the length of the lineal structure, and/or mechanically fastening the target insert to the internal screw boss within the lineal structure.

These and other advantages will be apparent to those skilled in the art based on the following disclosure.

BRIEF DESCRIPTION OF THE DRAWINGS

Many aspects of the present disclosure will be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views. It should be recognized that these implementations and embodiments are merely illustrative of the principles of the present disclosure. Therefore, in the drawings.

DETAILED DESCRIPTION

Figure 1A:
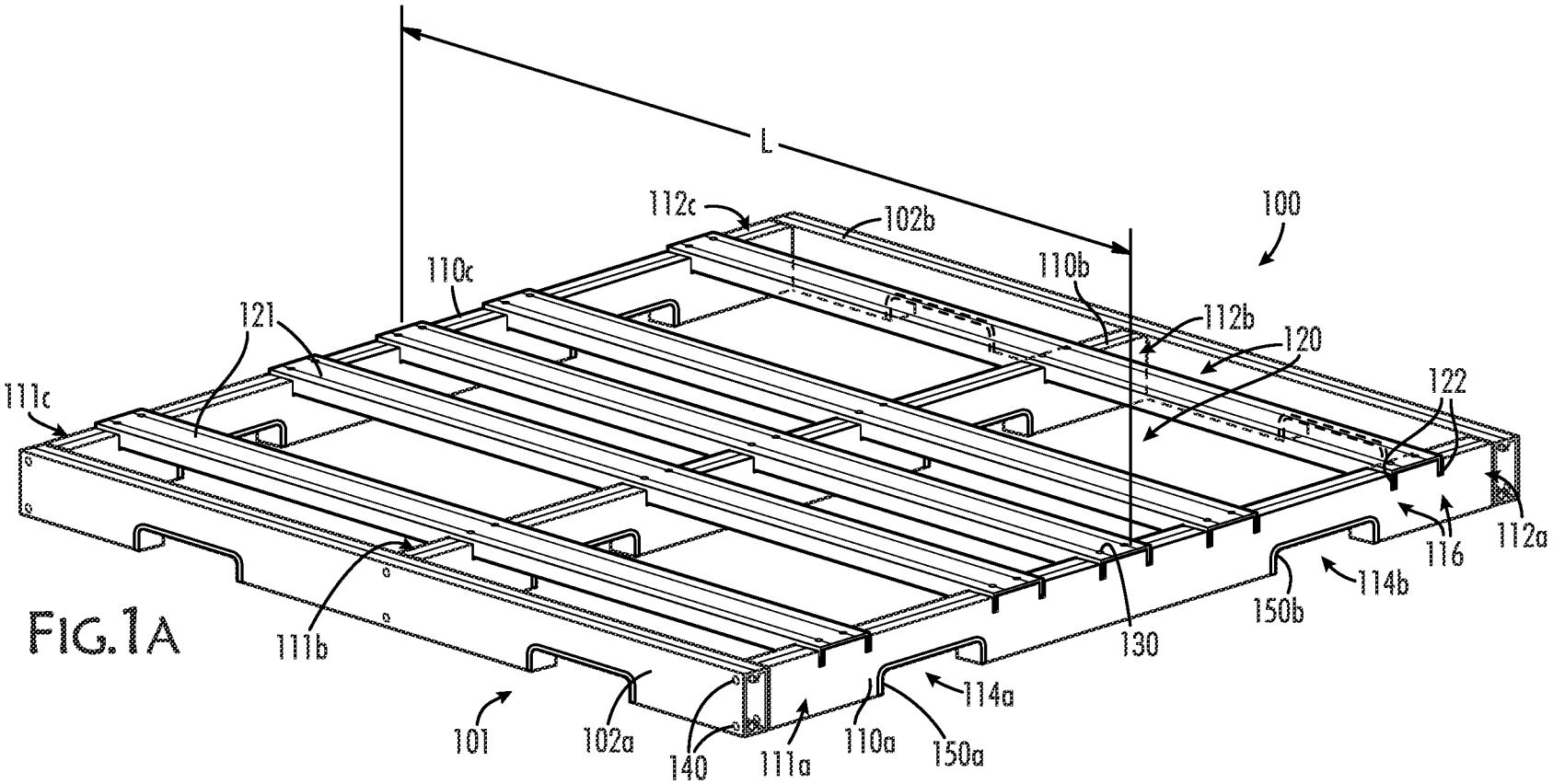
FIG. 1A is a perspective view of an illustration of an example pallet assembly according to the present disclosure.

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

Throughout this specification and the claims, the terms "comprise," "comprises," and "comprising" are used in a non-exclusive sense, except where the context requires otherwise. Likewise, the term "includes" and its grammatical variants are intended to be non-limiting, such that recitation of items in a list is not to the exclusion of other like items that can be substituted or added to the listed items.

I. Example Use Case Scenarios

The lack of a single international standard for pallets causes substantial continuing expense in international trade. A single standard is difficult because of the wide variety of needs a standard pallet would have to satisfy. However, due to the International Plant Protection Convention (IPPC), most pallets shipped across national borders must be made of materials that are incapable of being a carrier of invasive species of insects and plant diseases. Pallets made of raw, untreated wood for example are not considered phytosanitary compliant. Moreover, wood pallets can pose serious bio-hazard risks as they are susceptible to bacterial and chemical contamination, such as *E. coli* problems in food and produce transportation, and even insect infestation.

To be phytosanitary compliant, wood pallets (or other wood packaging material) must meet debarked standards and must be treated by either of the following means under the supervision of an approved agency: heated to achieve a minimum core temperature of about 56.0° C. (132.8° F.) for at least 30 minutes; or fumigated with methyl bromide (except within all EU member states).

Pallets (also described as pallet assemblies herein) made of non-wood materials such as steel, aluminum, plastic, engineered wood products, such as plywood, oriented strand board, or corrugated fiberboard, or as shown and described herein do not need IPPC approval, and are considered to be exempt from certain phytosanitary regulations. Despite the above, the production of pallets accounts for about 43.0% of hardwood and about 15.0% of softwood usage in the U.S.

The reason for this is simple: the cheapest pallets are made of softwood and are often considered expendable, to be discarded as trash along with other wrapping elements, at the end of transport from one location to another. These pallets are simple stringer pallets, and able to be lifted from two sides.

Slightly more complex, hardwood block pallets, plastic pallets, and metal pallets can be lifted from all four sides. These costlier pallets usually require a deposit and are returned to the sender or resold as used. Many "four way" pallets are color-coded according to the loads they can bear, and other attributes.

Synthetic pallets are often made of synthetic or recycled materials. These materials may be a recycled polymer, that is then blended with a recycled additive for strengthening and adding coarseness. For example, scrap or waste PET polymer may be blended with waste carbon fiber, fiber glass, or bast fibers, and then extruded or otherwise injection molded into the various components of this disclosure. Synthetic pallets are thus durable, long-lasting, infinitely recyclable, chemically inert, and are typically weather, water, rot, and corrosion-resistant. However, they usually involve relatively complex and expensive manufacturing methods for mass production when compared to wood or semi-organic pallets for the same strength and stability.

As such, in at least one aspect, the disclosure herein is directed to improved transport structures or skids, in particular, to pallet assemblies and pallet components, and to improved methods of producing and assembling the same.

In the same vein, the lessons and techniques disclosed herein are applicable to any transport structure or support structure.

II. Systems and Methods

In one aspect, the transport structure or skid according to the present disclosure is a multi-component system that allows for rapid assembly, use, and/or disassembly of the structure. The transport structure or skid, in one aspect, includes a plurality of extruded or pultruded components that are free of biological activity and exempt from phytosanitary regulations or equivalent (herein referred to as "inert"). These components can be easily transported (stacked or nested, for example) and assembled on site. In another aspect, the transport structure or skid is a pallet assembly of the stringer type, as is understood in the art. In another aspect, the pallet assembly is a block type pallet assembly, as is understood in the art, or any other type of pallet assembly (e.g., skid pallets, carrier pallet, flush pallet, perimeter base pallet, two-way or four-way) made possible with the inert, extrusion or pultrusion components according to the present disclosure.

In one aspect, the pallet assembly according to the present disclosure includes an inert frame and one or more inert support surfaces attached thereto. The pallet assembly, in one aspect, includes a frame formed by two, engagement structures (or "engagement stringers", as referred to herein) having a plurality of perpendicular engagement structures or "stringers" therebetween and engaged, respectively, to each engagement stringer. The frame may be formed by block components or any other type(s) of components called for by the different types of pallet assemblies. Moreover, the frame or the frame components, in another aspect, may be further processed (e.g., cut, sheared, sawed, etched, chamfered, notched, bent, drilled, bored, built-up, chemically prepared, etc.) as need. Furthermore, the frame or the frame components may be further processed to include internal structures (embedded or removable/replaceable) or target inserts that are the same or a different material, for example, than the frame or the frame components. In another aspect, the target inserts may be formed via injection molding using hard, strong, and durable materials, or any of the materials or compositions described herein.

In one aspect, the one or more support surfaces are a plurality of deck boards or top slats supported and retained/held directly by the frame. The deck board(s) or top slats may include a structure that is complementary to a feature defined by the frame and that allows the deck board(s) or top slats to mate with and be held by the frame. In another aspect, the pallet assembly demands fasteners only for assembling the frame. In another aspect, the pallet assembly has optional or non-optional fasteners for attaching the deck board(s) or top slats to the frame for added rigidity and stability.

In one aspect, the stringers and the top slats are each lineal construction members produced from an extrusion or pultrusion manufacturing process using inert materials. The components for the pallet assembly in the form of lineal members may be made at least in part of polymeric materials or equivalent, e.g., low-density polyethylene (LDPE) (a chemically inert, flexible, insulator), high-density polyethylene (HDPE) (inert, thermally stable, tough and high tensile strength); polypropylene (resistant to acids and alkalis, high tensile strength); polyvinyl chloride (PVC) (insulator, flame retardant, chemically inert); polychlorotrifluoroethylene (PCTFE) (stable to heat and thermal, high tensile strength and non-wetting); polyamide (Nylon) (high melting point, excellent abrasion resistance); polyethylene terephthalate (PET) & (PETG) (High strength and stiffness, broad range of use temperatures, low gas permeability), etc. The components for the pallet assembly also may be made of recycled materials or may incorporate internal reinforcement such as embedded reinforcement fibers (glass fibers, carbon fibers, bast fibers) as is understood in the art. The components for the pallet assembly, in another aspect, may be formed entirely of rolled metal, in particular, rolled steel or steel alloys or sheet metal. The rolled steel aspect prevents chemical vapors and meets certain shipping standards for controlled products. The components for the pallet assembly, in another aspect, may be formed of "color-blend" recycled plastics or polymers as is known in the art. The components for the pallet assembly, in another aspect, may be formed of scrap carbon fiber, and fiber glass and glass fibers, as well as any other polymers and/or any other natural (e.g., plant-based or plant derived) or non-natural fiber(s).

The engagement stringers, in one aspect, serve to receive and hold the only mechanical fasteners demanded by the pallet assembly (for securably attaching the stringers). In another aspect, the pallet assembly calls for mechanical fasteners for the top slats and/or any other component of the assembly (e.g., any other slats, the target inserts). In another aspect, the stringers define a slot(s) for receiving and holding the top slats. In another aspect, the components for the pallet assembly include bottom slats and the stringers also define a slot(s) for receiving and holding the bottom slats opposite the top slats. In another aspect, each of the stringers defines a target (s) to facilitate engagement of the pallet assembly with lift, move, and/or transport equipment.

In particular, in one aspect, each of the engagement stringers and/or each of the stringers includes a screw boss(es) to receive the assembly screws. In another aspect, the screw boss(es) and assembly screws help to securably attach each of the stingers, respectively, to each of the engagement stringers to form the frame. Importantly, assembly screws may be driven into the screw boss(es) that are exposed at the ends of the stringer. The assembly screws also may be driven (e.g., from the side(s) or from within at any point along the length of the stringer, for example, into the internal screw boss (the entire screw boss extending along a length of the stringer).

In one aspect, each of the slats is configured as a flat lineal platform having two legs. In this way, the cross-section of the slat along its length is generally Π-shaped. Moreover, each of the legs of the slat is configured to fit (e.g., loosely fit, friction fit, press fit, snap fit, wedge fit) into each of the slots defined by the stringers. As such, the slats are supported and held directly by the stringers of the frame, and the slats provide a flat support surface for the pallet.

In one aspect, the pallet assembly and/or the pallet component(s) incorporate or is made of a non-homogeneous composition of matter having both compressive strength and stiffness which enables it to be used as a substitute for wood in a wide variety of applications. In another aspect, the structural composite for the pallet component(s) according to the present disclosure can substitute for other materials with higher strength modulus than wood, such as aluminum.

In particular, in one aspect, the pallet assembly and/or the pallet component(s) are engineered, meaning that its exterior shape and the choice of its external or internal features or components (e.g., screw boss(es), top guide(s), screw line(s)) and their locations and shapes are based at least in part on the demands as specified herein. The pallet assembly and/or the pallet component(s) may be extruded or pultruded lineal composite structures produced with embedded reinforcement(s) that are spaced away from the neutral axis, analogous to the flanges on and I-beam, or asymmetrically situated, in order to provide increased strength and stiffness in one or both axes perpendicular to the cross-section.

In one aspect, the pallet assembly and/or the pallet component(s) incorporate or is made of a structural polymeric composite, which include a polymer and stiffening additivities, typically waste glass fiber, carbon fiber, or bast fibers. In one aspect, the pallet assembly and pallet component(s) incorporate polyvinyl chloride (PVC) and/or recycled PVC. In one aspect, the pallet assembly and pallet component(s) incorporate polyamides. In one aspect, the pallet assembly and pallet component(s) incorporate a shredded fibrous material, for example, shredded carbon fiber. In one aspect, the pallet assembly and pallet component(s) incorporate a shredded fibrous material, for example, shredded fiberglass in waste, virgin, or blended form (waste+virgin). In one aspect, the pallet assembly and pallet component(s) incorporate a shredded fibrous material, for example, shredded bast fibre. In one aspect, the pallet assembly incorporates a first polymeric layer of PVC and/or recycled PVC, in which an additive is applied.

Referring to methods herein, in one aspect, a method of assembling a pallet is disclosed. In one aspect, the method comprises providing a lineal engagement stringer, a lineal stringer, a lineal slat, and providing a mechanical fastener. The method also comprises, in another aspect, securably fastening a first end of the lineal stringer to the lineal engagement stringer and pressing a leg of the lineal slat into a slot of the lineal stringer such that a portion of a main wall of the lineal slat sits on the portion of the top wall of the lineal stringer.

In one aspect, the component elements allow for circularity in assembly, disassembly, and repair of broken components. Namely, the infinitely recyclable components may be repaired when broken by shredding, reheating, extruding or molding, and replacing the broken part. Thus, aspects of this disclosure allow cradle to cradle use of patents, lowering the costs of making pallets from virgin materials, and reducing emissions and greenhouse gases associated with creating more virgin material.

In one aspect, a method of using the pallet components is disclosed. In another aspect, the pallet components are stacked or nested and transported in a box. The stacked and/or nested pallet components conserve space and allow for ready and fast assembly on site.

III. With Reference to the Figures

The term "extruded" is used herein for convenience but engagement stringers, stringer, and slats may be formed in any way customary in the industry, for example, pultruded and co-extruded with other materials. Resin fusion and vacuum fusion methods are also envisioned.

The term "lineal" is used herein to refer to an extruded pallet component having a uniform cross section perpendicular to its major dimension which major dimension is much longer than its other two dimensions; that is, the plane of any cross section perpendicular to the major dimension of the pallet component is defined by a line parallel to the major dimension.

The term "non-homogeneous" as used herein means that at least some of the constituents are concentrated within the structural composite rather than being homogeneously dispersed.

The term "screw boss" is a physical structure that grips the threads of a screw being driven into it so that, once the screw has been inserted into or through the screw boss, the screw boss resists the removal of the screw more when the screw is pulled than when the screw is unscrewed.

A "mechanical fastener" is a mechanism or structure that helps to fasten to items or two components together, and may include but is not limited to screws, nails, bolts, pegs, mating structures, snap or button mechanisms, etc.

Accordingly, a user, a business, a military contractor, and/or any of the armed services can affectively manufacture, stack/nest, assemble, use, disassemble, store, and/or recycle the pallet components for the pallet assembly based on the systems and methods of the present disclosure. The pallet components and the resulting pallet assemblies according to the present disclosure are lighter, stronger (i.e., can hold more total weight than a comparably structured stringer pallet, for example) and take up less space than conventional pallet components or pallet assemblies. The pallet components and the resulting pallet assemblies according to the present disclosure allow for ready and efficient transport of pallet components on site, as needed, and rapid assembly/disassembly and use of those components and resulting pallets. All these advantages made possible with readily-available and/or recycled inert materials that are not at risk for chemical or biological impregnation or infestation.

Referring now to FIG. 1A, a perspective view of an illustration of an example pallet assembly according to the present disclosure is shown. In particular, in FIG. 1A there is shown a multi-component, stringer type, two-way pallet assembly 100 assembled from a plurality of extruded lineal components made of inert materials, namely, recycled PVC and fiber.

As illustrated in FIG. 1A, the pallet assembly 100 includes a frame 101 and a support surface 120 attached to the frame 101. More specifically, in FIG. 1A, the frame 101 includes two or more engagement stringers 102, in particular, a first engagement stringer 102*a* arranged opposite and parallel to a second engagement stringer 102*b*, and a plurality of perpendicular stringers 110 engaged, respectively, to each of the engagement stringers 102*a*, 102*b*. Moreover, and with further specificity, each of the plurality of stringers 110 (in particular, each of a first stringer 110*a*, a second stringer 110*b*, and a third stringer 110*c*, which are arranged in parallel) of the frame 101 has a first end 111 and a second end 112, and each first end 111 of the stringers 110*a*, 110*b*, 110*c* is engaged to the first engagement stringer 102*a* and each second end 112 of the stringers 110*a*, 110*b*, 110*c* is engaged to the second engagement stringer 102*b*. Each of the plurality of stringers 102, 110 also is processed to include two or more cut-out targets 114, in particular, a first target 114*a* and a second target 114*b* each configured to receive an injection molded target insert 150 (best seen in FIG. 2C) to reinforce the stringer 110 and to facilitate lifting of the resulting pallet assembly 100 by forklift. Each of the plurality of stringers 110 also is processed to include a plurality of surface features 116 or slots (best seen in FIG. 4A) that allows the support surface 120 to mate with and be held by the frame 101.

Depending on the embodiment, additional stringers 110 may be part of the pallet assembly 100 and be similarly situated and engaged between the engagement stringers 102 (i.e., the engagement stringers 102 being longer and/or the spacing of the stringers 110 being different than that illustrated). Furthermore, depending on the embodiment, additional engagement stringers 102 (and/or longer mechanical fasteners 140, as discussed in greater detail herein; see FIG. 3) may be part of the pallet assembly 100, and used to double-up or reinforce the first engagement stringer 102*a* and/or the second engagement stringer 102*b*. Moreover, the frame or the frame components may be further processed (e.g., cut, sheared, sawed, etched, chamfered, bent, pre-drilled, bored, built-up, chemically prepared, etc.). In some aspects, the lineal components will be pre-drilled or pre-bored to allow for easy configuration with mechanical fasteners. Furthermore, each of the engagement stringers 102, each of the stringers 110, and/or each of the top slats 121 may incorporate embedded reinforcement fibers, strands, or rebar-like lineal structures according to the present disclosure. Depending on the embodiment, each of the engagement stringers 102, each of the stringers 110, and/or each of the top slats 121 may be formed entirely of rolled metal instead of being an extrusion or pultrusion product. Regardless of the composition the various components may be prepared with pre-drilling, or treated with exterior additives to ensure longevity, such as oils for the rolled steel, or UV protection on the synthetic polymer embodiments.

Returning to FIG. 1A, the support surface 120 includes a plurality of top slats 121 configured to be engaged/retained and directly supported by the plurality of stringers 110 of the frame 101. In particular, in FIG. 1A, each of the top slats 121 also is configured as a flat lineal platform having two legs 122 and having a cross-section along its length, L, that is generally Π-shaped, and complementary to the slots 116 defined by each of the stringers 110. As such, each of the legs 122 of each of the top slats 121 is configured to fit into each of the slots 116. The top slats 121, in this way, are supported and held directly by the frame 101. The top slats 121 also provide a stable and secure flat support surface 120.

Figure 1B:
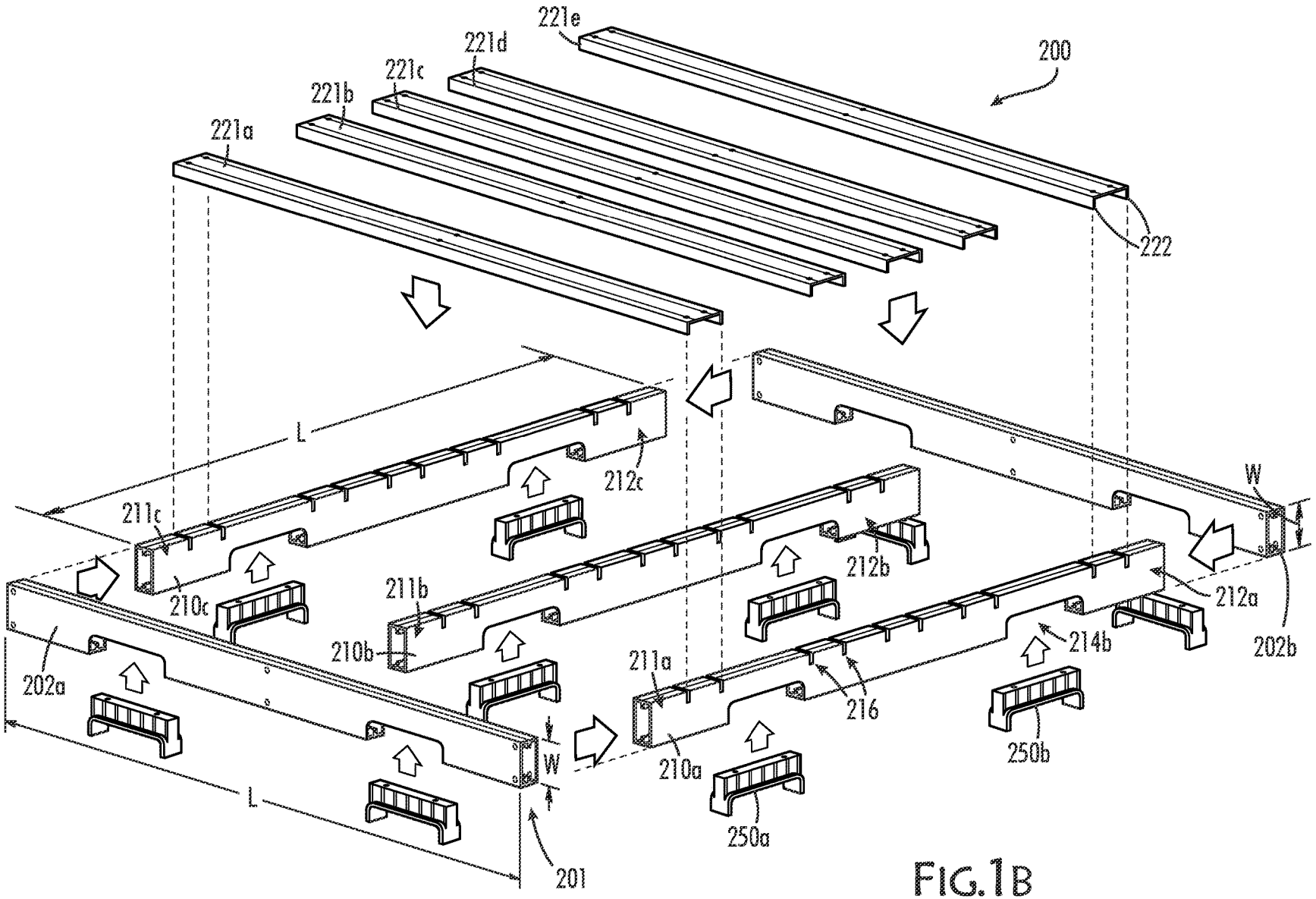
FIG. 1B is a perspective view of an exploded illustration of an example pallet assembly according to the present disclosure.

Referring now to FIG. 1B, a perspective view of an exploded illustration of an example pallet assembly according to the present disclosure is shown. In particular, in FIG. 1B, there is shown a multi-component, stringer type, two-way pallet assembly 200 having an engagement stringer 202*a* arranged opposite and parallel to a second engagement stringer 202*b*; and a first stringer 210*a*, a second stringer 210*b*, and a third stringer 210*c* arranged in parallel between the engagement stringers 202*a*, 202*b*. As illustrated, the first stringer 210*a*, the second stringer 210*b*, and the third stringer 210*c* are to be engaged, respectively, via mechanical fasteners 240, to each of the engagement stringers 202*a*, 202*b* to form a frame 210. Moreover, a plurality of top slats 221, in particular, a first top slat 221*a*, a second top slat 221*b*, a third top slat 221*c*, a fourth top slat 221*d*, and a fifth top slat 221*e* (each having two legs 222 that are complementary to the slots 216 defined by each of the stringers 210), are to be fit into each corresponding slot 216 and placed on the first stringer 210*a*, the second stringer 210*b*, and the third stringer 210*c*.

Moreover, and with further specificity, each of the plurality of stringers 210*a*, 210*b*, 210*c* has a first end 211 and a second end 212, and each first end 211 of the stringers 210*a*, 210*b*, 210*c* is to be engaged to the first engagement stringer 202*a* (via the mechanical fasteners 240*a*) and each second end 212 of the stringers 210*a*, 210*b*, 210*c* is to be engaged to the second engagement stringer 202*b* (via the mechanical fasteners 240*b*) to form the frame 201. Each of the plurality of stringers 202, 210 also are processed to include a first cut-out target 214*a* and a second target 214*b* each configured to receive an injection molded target insert 250*a*, 250*b* to reinforce the stringers 202, 210 and to facilitate lifting of the resulting pallet assembly 200 by forklift. Each of the plurality of stringers 210 also is processed to include a plurality of slots 216 (best seen in FIG. 4A) that allows the plurality of top slats 221 to mate with and be held by the frame 201 (via the mechanical fasteners 230, for example).

Returning generally to FIG. 1B, the first engagement stringer 202*a* and the second engagement stringer 202*b* serve to receive and hold the mechanical fasteners 240 for securably attaching each of the first stringer 210*a*, the second stringer 210*b*, and the third stringer 210*c*. Depending on the embodiment, each of the engagement stringers 202 and/or each of the stringers 210 include a screw boss(es) (best seen in FIG. 3) to receive the mechanical fasteners 230, 240 or any other mechanical fasteners (best seen in FIGS. 3 and 4A). Importantly, as illustrated in FIG. 1B, the mechanical fasteners 230, 240 may be driven into the screw boss(es) (the entire screw boss extending along the length, L, of the stringers 210) with each of the stringers 202, 210.

Figure 1C:
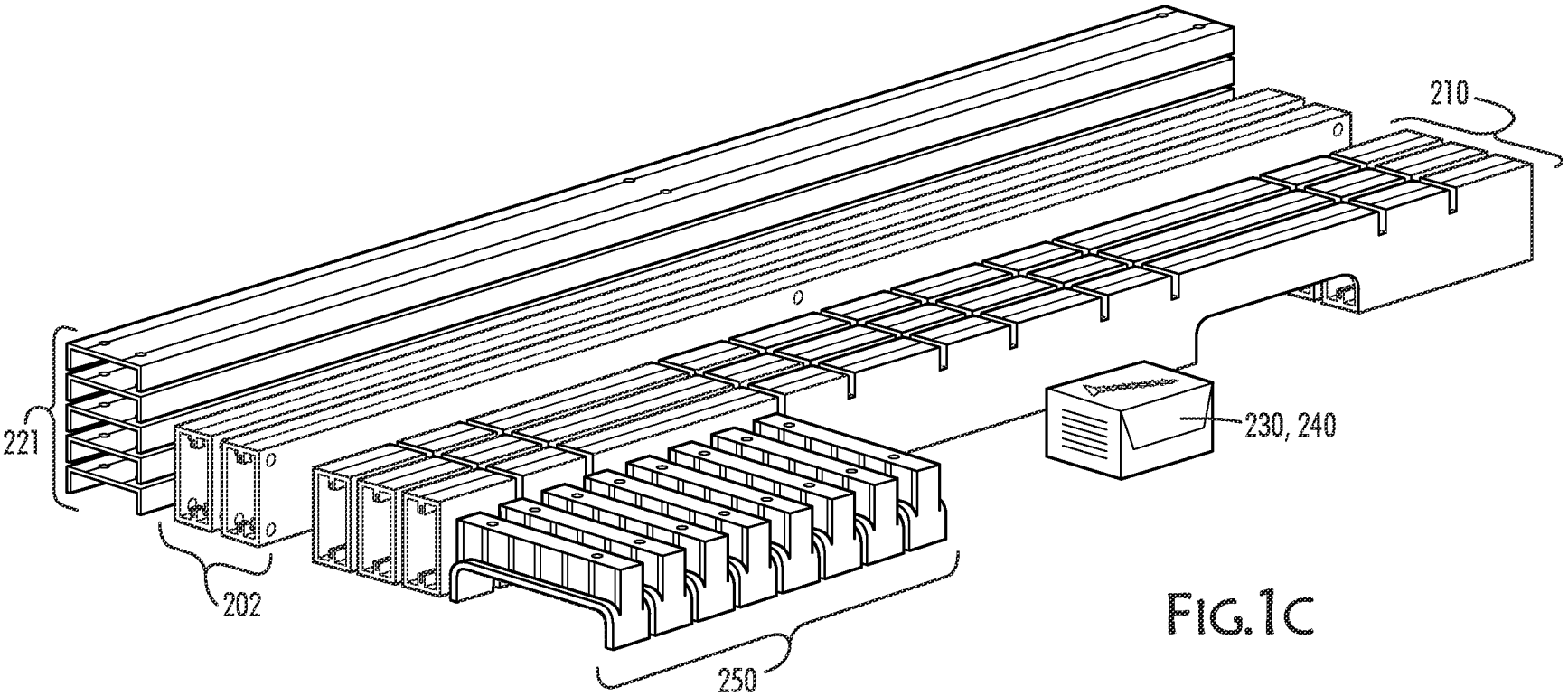
FIG. 1C, a perspective view of an illustration of the example pallet assembly of FIG. 1B organized as a kit and ready to be shipped in a box.

Referring now to FIG. 1C, a perspective view of an illustration of the example pallet assembly of FIG. 1B organized as a kit and ready to be shipped in a box is shown. In particular, in FIG. 1C, there is shown the multi-component, stringer type, two-way pallet assembly 200 of FIG. 1B. The engagement stringers 202 are arranged together, as are the stringers 210. The plurality of top slats 221 are stacked, and the injection molded target inserts 250 are together. Moreover, the mechanical fasteners 230, 240 are in a box. Together, all of the components are arranged such that they can be packed and shipped for fast and ready assembly.

Figure 2:
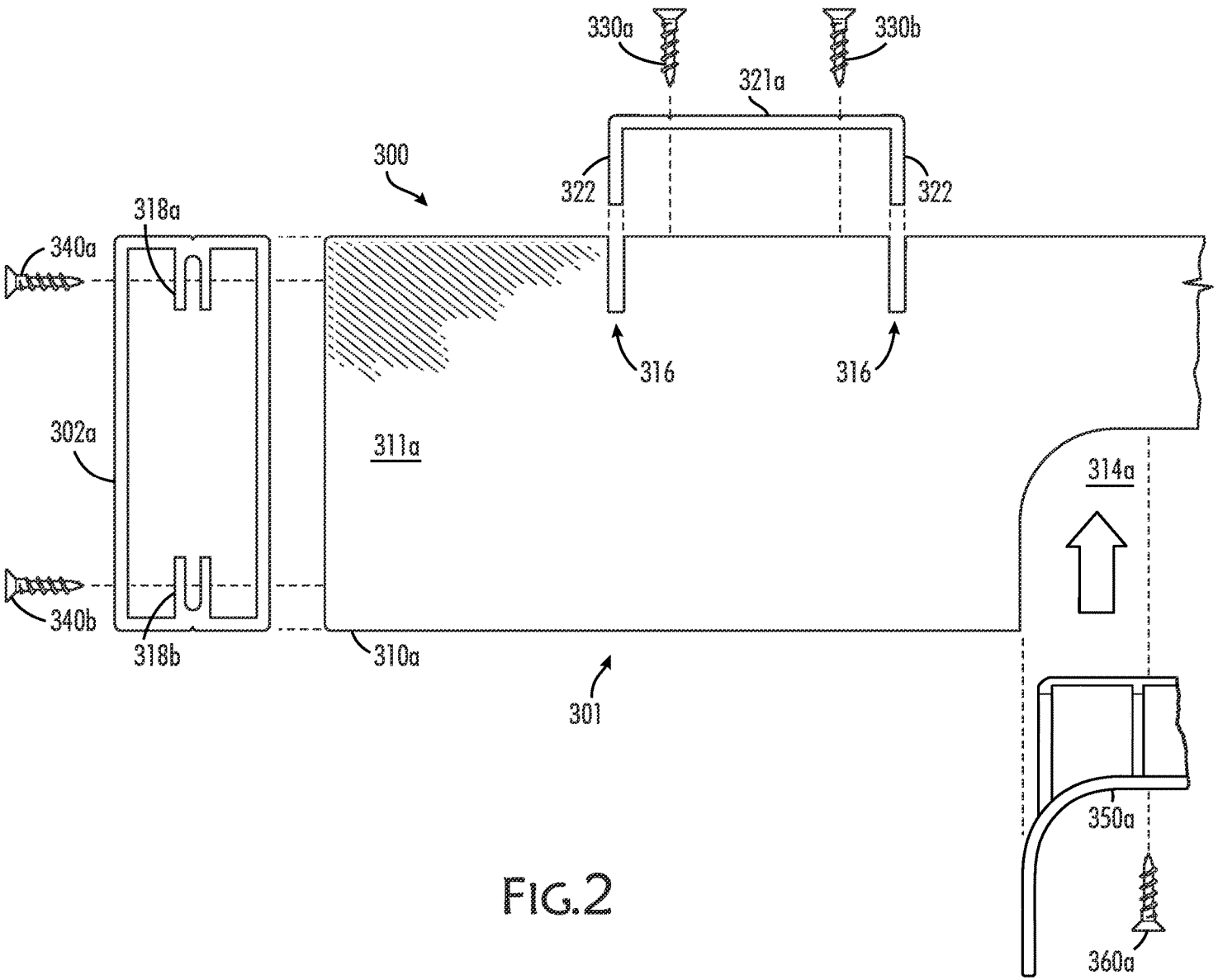
FIG. 2 is a side view of a partial, exploded illustration of an example pallet assembly according to the present disclosure.

Referring now to FIG. 2, is a perspective view of a partial illustration of an example pallet assembly according to the present disclosure is shown. In particular, in FIG. 2, there is shown a pallet assembly 300 having a first engagement stringer 302*a*, a second engagement stringer 302*b* (not shown), a first stringer 310*a*, a second stringer 310*b* (not shown), a third stringer 310*c* (not shown), a first top slat 321*a*, a second top slat 321*b* (not shown), a third top slat 321*c* (not shown), a fourth top slat 321*d* (not shown), a fifth top slat 321*e* (not shown), and mechanical fasteners 330, 340. More specifically, as illustrated, the side view of FIG. 2 is from the perspective of a first end 311*a* (opposite a second end 312*a*; not shown) of the first engagement stringer 302*a*. The side view of FIG. 2 also shows an injection molded target insert 350*a* for a first target 314*a* at a first end 311 of the of the stringer 310*a*.

As shown in FIG. 2, the engagement stringers 302 and the stringers 310 each have internal screw bosses 318*a*, 318*b* to receive the mechanical fasteners 330, 340 (or a portion of the mechanical fasteners 330, 340) or any other fasteners that are part of the assembly (e.g., mechanical fasteners 360). Importantly, individual mechanical fasteners 340*a*, 340*b* are driven through the screw bosses 318*a*, 318*b* of the engagement stringer 302*a* and, for example, into the screw bosses 318*a*', 318*b*' that are exposed at the ends of the stringer 310*a*. In particular, in FIG. 2, the individual mechanical fasteners 340*a*, 340*b* may be driven at two pre-drilled points (best seen in FIG. 3) along the width, W, of the first engagement stringer 302*a* and through the internal screw bosses 318*a*, 318*b* (the screw bosses extending along the length, L, of the stringers 302, 310). Moreover, the individual mechanical fasteners 340*a*, 340*b* are then driven (best seen in FIG. 3) into the internal screw bosses 318*a*', 318*b*' of the first stringer 310*a*. Moreover, individual mechanical fasteners 330*a*, 330*b* may be driven through the screw boss 318*a*' of the stringer 310*a*. In particular, in FIG. 2, the individual mechanical fasteners 330*a*, 330*b* may be driven at two pre-drilled points (best seen in FIG. 3) along the length, L, of the stringer 310*a* and through the internal screw boss 318*a*' (the screw boss extending along the length, L, of the stringer 310*a*). Furthermore, individual mechanical fasteners 360*a*, 360*b* may be driven through the screw boss 318*b*' of the stringer 310*a*. In particular, in FIG. 2, the individual mechanical fasteners 360*a*, 360*b* may be driven at two pre-drilled points (best seen in FIG. 4A) along the length, L, of the stringer 310*a* and through the internal screw boss 318*b*' (the screw boss extending along the length, L, of the stringer 310*a*).

Figure 3:
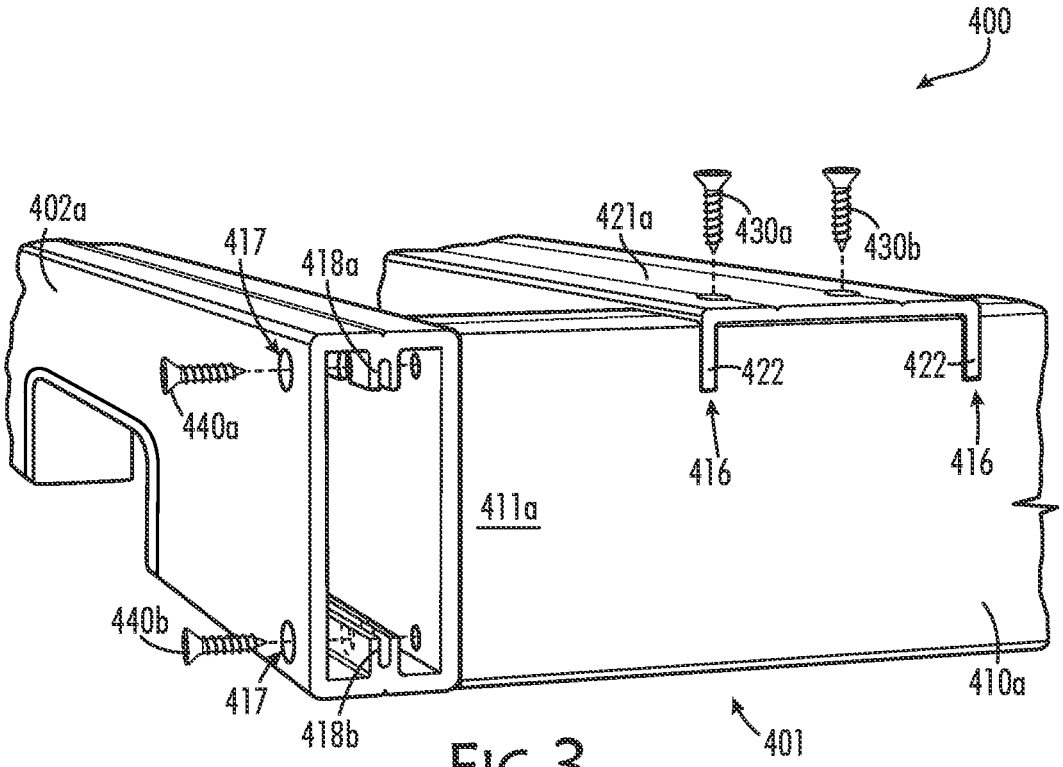
FIG. 3 is a perspective view of a partial illustration of an example pallet assembly according to the present disclosure.

Referring now to FIG. 3, a perspective view of a partial illustration of an example pallet assembly according to the present disclosure is shown. In particular, in FIG. 3, there is shown a pallet assembly 400 having a first engagement stringer 402*a*, a second engagement stringer 402*b* (not shown), a first stringer 410*a*, a second stringer 410*b* (not shown), a third stringer 410*c* (not shown), a first top slat 421*a*, a second top slat 421*b* (not shown), a third top slat 421*c* (not shown), a fourth top slat 421*d* (not shown), a fifth top slat 421*e* (not shown), and mechanical fasteners 430, 440. As illustrated, the first engagement stringer 402*a* serves to receive and hold the mechanical fasteners 440*a*, 440*b* for securably attaching the first stringer 410*a* to the engagement stringer 402*a*. The first stringer 410*a* is processed to include surface features 416 or slots (best seen in FIG. 4A) to allow the first top slat 421*a* to mate with and be held by the frame 401. In particular, in FIG. 3, the first top slat 421*a* has two legs 422 that are complementary to the slots 416 defined by the first stringer 410*a*, and are fit into each corresponding slot 416. Mechanical fasteners 430*a*, 430*b* are driven through the first top slat 421*a* and into the first stringer 410*a* (into the internal screw boss 418*a*'; not shown) to provide additional engagement support between the first top slat 421*a* and the first stringer 410*a*.

Moreover, and with further specificity, the first end 411*a* of the first stringer 410*a* is to be engaged to the first engagement stringer 402*a* via the mechanical fasteners 440*a*, 440*b* to form a corner of a frame 401. As shown in FIG. 3, the first engagement stringer 402*a* has internal screw bosses 418*a*, 418*b* to receive a portion of the mechanical fasteners 440*a*, 440*b*. Importantly, similar to the illustration of FIG. 1B, individual mechanical fasteners 440*a*, 440*b* are driven through the screw bosses 418*a*, 418*b*, respectively, of the first engagement stringer 402*a* into the screw bosses 418*a*', 418*b*' (not shown), respectively, of the first stringer 410*a*. In particular, in FIG. 3, the individual mechanical fasteners 440*a*, 440*b* are driven through two pre-drilled holes 417 defined by the first engagement stringer 402*a*.

Figure 4A:
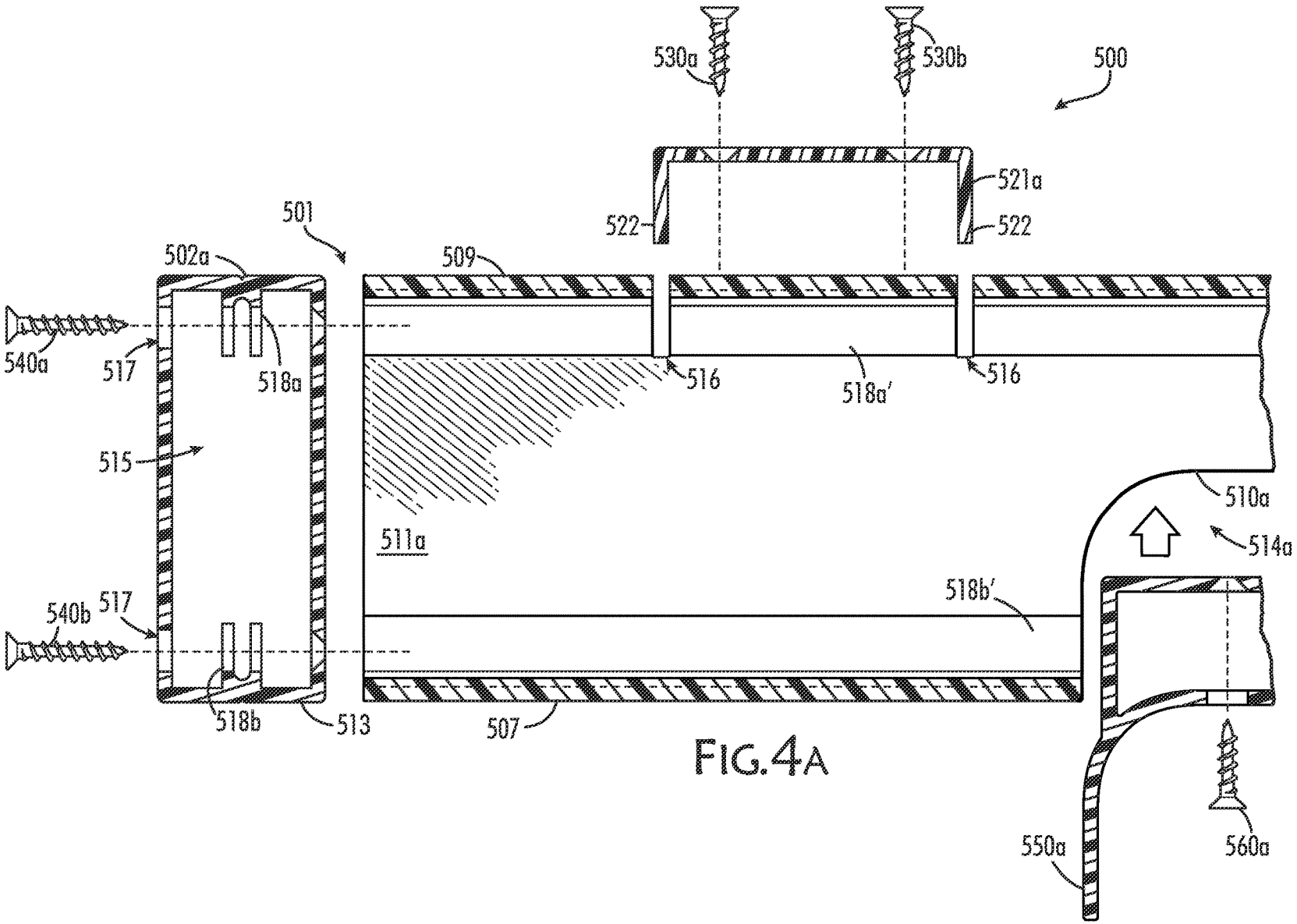
FIG. 4A is a cross-sectional view of a partial, exploded illustration of an example corner of an example frame of an example pallet assembly according to the present disclosure.

Referring now to FIG. 4A, a cross-sectional view of a partial exploded illustration of an example corner of an example frame of an example pallet assembly according to the present disclosure is shown. In particular, in FIG. 4A, there is shown a pallet assembly 500 having a first engagement stringer 502*a*, a second engagement stringer 502*b* (not shown), a first stringer 510*a*, a second stringer 510*b* (not shown), a third stringer 510*c* (not shown), a first top slat 521*a*, a second top slat 521*b* (not shown), a third top slat 521*c* (not shown), a fourth top slat 521*d* (not shown), a fifth top slat 521*e* (not shown), and mechanical fasteners 530, 540, 560. As illustrated, the first engagement stringer 502*a* serves to receive and hold the mechanical fasteners 540*a*, 540*b* for securably attaching the first stringer 510*a*. The first stringer 510*a* is processed to include a first cut-out target 514*a* (shown) and a second target 514*b* (not shown) configured to receive an injection molded target insert 550*a* (shown), 550*b* (not shown) to reinforce the first stringer 510*a*. The first stringer 510*a* also is processed to include a plurality of slots 516 that allows the plurality of top slats 521 to mate with and be held by the frame 501.

In particular, in FIG. 4A, the first engagement stringer 502*a* has profile including an internal space 515 and a profile wall 513 at least partially defining the internal space 515. Moreover, the first stringer 510*a* has a first end 511*a*, a second end 512*a* (not shown), a top wall 509, a bottom wall 507, and internal screw bosses 518*a*', 518*b*'. Moreover, as illustrated, the first top slat 521*a* has two legs 522 that are complementary to the slots 516 defined by the top wall 509 of the first stringer 510*a*. Mechanical fasteners 530*a*, 530*b* may be driven through the first top slat 521*a* and into the internal screw boss 518*a*' to provide additional engagement support between the first top slat 521*a* and the first stringer 510*a*.

Moreover, and with further specificity, the first end 511*a* of the first stringer 510*a* is to be engaged to the first engagement stringer 502*a* via the mechanical fasteners 540 to form a corner of a frame 501. As shown in FIG. 4A, the first engagement stringer 502*a* has internal screw bosses 518*a*, 518*b* to receive a portion of the mechanical fasteners 540*a*, 540*b*. Importantly, similar to the illustration of FIGS. 1B and 3, individual mechanical fasteners 540*a*, 540*b* are driven through the screw bosses 518*a*, 518*b*, respectively, of the first engagement stringer 502*a* into the screw bosses 518*a*', 518*b*', respectively, of the first stringer 510*a*. In particular, in FIG. 4A, the individual mechanical fasteners 540 are driven through two pre-drilled holes 517 defined by the first engagement stringer 502*a*.

Furthermore, with further specificity, the first end 511*a* of the first stringer 510*a* is processed to include a first cut-out target 514*a* (shown) and a second target 514*b* (not shown) each configured to receive an injection molded target insert 550*a* (shown) and 550*b* (not shown), respectively. The bottom wall 507 of the first stringer 510*a* may be cut and processed to expose an opening to the internal space 515 and to remove a portion of the internal screw boss 518*b*'. In this way, the injection molded target insert 550*a* can be inserted into the target 514*a* such that the injection molded target insert 550*a* buts up against the internal screw boss 518*a*'. The individual mechanical fastener 560*a* is then driven through the injection molded target insert 550*a* and into the internal screw boss 518*a*' to securably engage the injection molded target insert 550 to the stringer 510*a*.

Figure 4B:
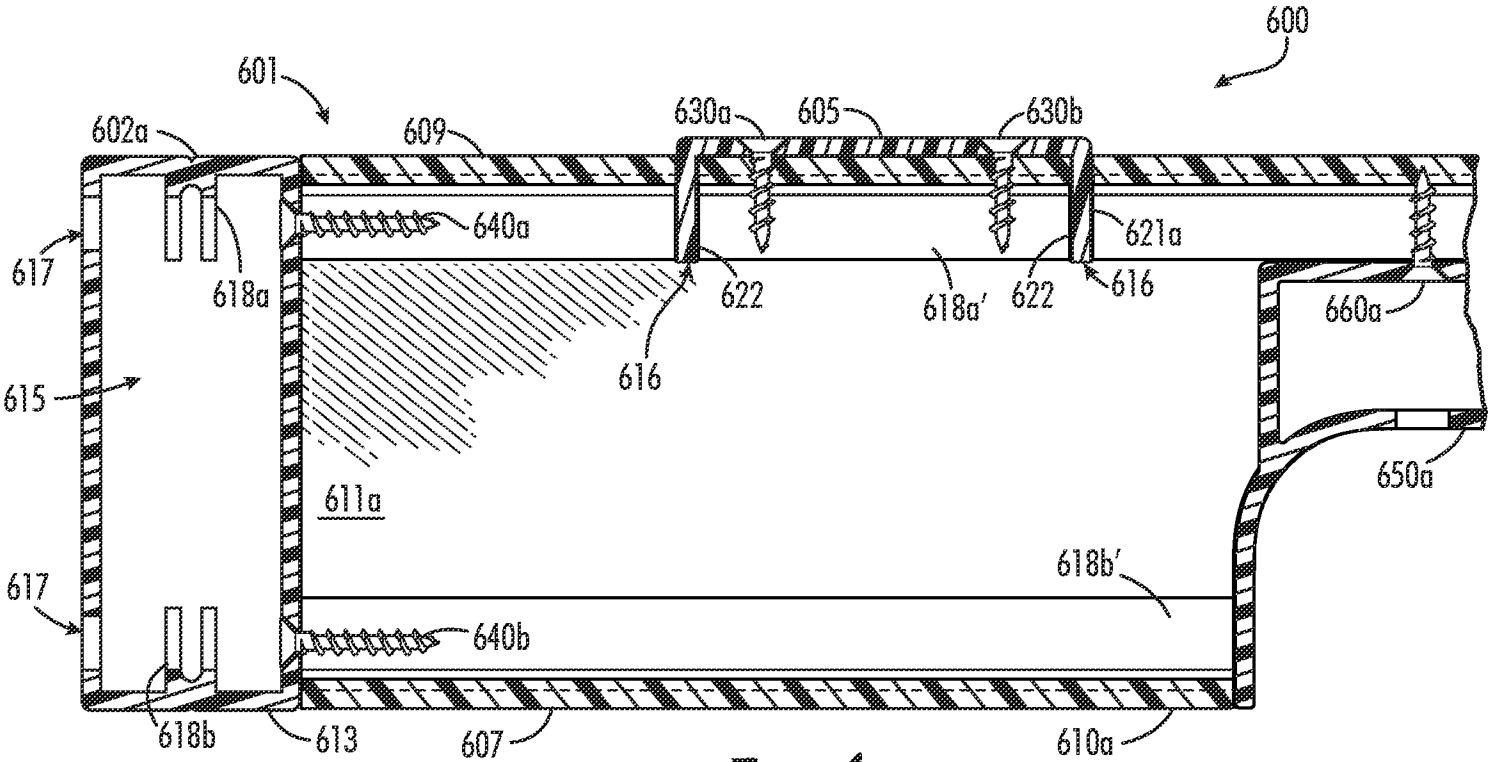
FIG. 4B is a cross-sectional view of a partial illustration of an example corner of an example frame of an example pallet assembly according to the present disclosure.

Referring now to FIG. 4B, a cross-sectional view of a partial illustration of an example corner of an example frame of an example pallet assembly according to the present disclosure is shown. In particular, in FIG. 4B, there is shown a pallet assembly 600 having a first engagement stringer 602*a*, a second engagement stringer 602*b* (not shown), a first stringer 610*a*, a second stringer 610*b* (not shown), a third stringer 610*c* (not shown), a first top slat 621*a*, a second top slat 621*b* (not shown), a third top slat 621*c* (not shown), a fourth top slat 621*d* (not shown), a fifth top slat 621*e* (not shown), and mechanical fasteners 630, 640, 660. As illustrated, the first engagement stringer 602*a* receives and holds the mechanical fasteners 640*a*, 640*b* to securably attach the first stringer 610*a*. The first stringer 610*a* also is processed to include surface features 616 and a first cut-out target 614*a* (shown) and a second target 614*b* (not shown) configured to receive an injection molded target insert 650*a* (shown), 650*b* (not shown) to reinforce the first stringer 610*a*

In particular, in FIG. 4B, the first engagement stringer 602*a* has profile including an internal space 615 and a profile wall 613 at least partially defining the internal space 615. Moreover, the first stringer 610*a* has a first end 611*a*, a second end 612*a* (not shown), a top wall 609, a bottom wall 607, and internal screw bosses 618*a*', 618*b*'. Moreover, as illustrated, the first top slat 621*a* has a main wall 605 and two legs 622 that are complementary to the slots 616 defined by the top wall 609 of the first stringer 610*a*. Mechanical fasteners 630*a*, 630*b* are driven through the first top slat 621*a* and into the internal screw boss 618*a*' to provide additional engagement support between the first top slat 621*a* and the first stringer 610*a*.

Moreover, and with further specificity, the first end 611*a* of the first stringer 610*a* is engaged to the first engagement stringer 602*a* via the mechanical fasteners 640*a*, 640*b* to form a corner of a frame 601. As shown in FIG. 4B, the first engagement stringer 602*a* has internal screw bosses 618*a*, 618*b* to receive a portion of the mechanical fasteners 640*a*, 640*b*. Importantly, individual mechanical fasteners 640*a*, 640*b* are driven through the screw bosses 618*a*, 618*b*, respectively, of the first engagement stringer 602*a* into the screw bosses 618*a*', 618*b*' of the first stringer 610*a*. In particular, in FIG. 4B, the individual mechanical fasteners 640 are driven through two pre-drilled holes 617 defined by the first engagement stringer 602*a*. Moreover, the individual mechanical fasteners 660 are driven through the injection molded target insert 650 and into the internal screw boss 618*a*' to securably engage the injection molded target insert 650 to the stringer 610*a*.

IV. Embodiments

Certain implementations of systems and methods consistent with the present disclosure are provided as follows:

Clause 1. A pallet assembly, comprising: (i) a lineal engagement stringer having a profile, the profile comprising an internal space and a profile wall at least partially defining the internal space; (ii) a lineal stringer having a first end, a second end, a top wall, and an internal screw boss, the top wall of the lineal stringer defining a plurality of slots; (iii) a lineal slat having a main wall and a leg, a portion of the leg configured to fit into a slot of the plurality of slots of the lineal stringer, a portion of the main wall configured to sit on a portion of the top wall when the leg is pressed into the slot of the lineal stringer; and (iv) a mechanical fastener for traversing the profile wall of the lineal engagement stringer and engaging with the internal screw boss of the lineal stringer, to securably fasten the first end of the lineal stringer to the lineal engagement stringer.

Clause 2. The pallet assembly of clause 1, wherein each slot of the plurality of slots of the lineal stringer corresponds to an individual lineal slat.

Clause 3. The pallet assembly of clause 1, wherein each pair of slots of the plurality of slots of the lineal stringer corresponds to an individual lineal slat.

Clause 4. The pallet assembly of clause 1, further comprising a second lineal engagement stringer and a second mechanical fastener for securably fastening the second end of the lineal stringer to the second lineal engagement stringer.

Clause 5. The pallet assembly of clause 1, further comprising a second lineal stringer and a third lineal stringer; wherein a second portion of the leg of the lineal slat is configured to fit into a slot of a plurality of slots of the second lineal stringer, a second portion of the main wall of the lineal slat configured to sit on a second portion of the top wall of the second lineal stringer when the leg is pressed into the slot of the lineal stringer and the leg is pressed into the slot of the second lineal stringer; and wherein a third portion of the leg of the lineal slat is configured to fit into a slot of a plurality of slots of the third lineal stringer, a third portion of the main wall configured to sit on a third portion of the top wall of the third lineal stringer when the leg is pressed into the slot of the lineal stringer and the leg is pressed into the slot of the second lineal stringer and the leg is pressed into the slot of the third lineal stringer.

Clause 6. The pallet assembly of clause 1, further comprising: a second lineal engagement stringer; a second lineal stringer and a third lineal stringer; a second mechanical fastener for securably fastening the second end of the lineal stringer to the second lineal engagement stringer; a third mechanical fastener for securably fastening the second end of the second lineal stringer to the second lineal engagement stringer; and a third mechanical fastener for securably fastening the second end of the third lineal stringer to the second lineal engagement stringer, wherein a second portion of the leg of the lineal slat is configured to fit into a slot of a plurality of slots of the second lineal stringer, a second portion of the main wall of the lineal slat configured to sit on a second portion of the top wall of the second lineal stringer when the leg is pressed into the slot of the lineal stringer and the leg is pressed into the slot of the second lineal stringer, and wherein a third portion of the leg of the lineal slat is configured to fit into a slot of a plurality of slots of the third lineal stringer, a third portion of the main wall configured to sit on a third portion of the top wall of the third lineal stringer when the leg is pressed into the slot of the lineal stringer and the leg is pressed into the slot of the second lineal stringer and the leg is pressed into the slot of the third lineal stringer.

Clause 7. The pallet assembly of clause 6, wherein the lineal engagement stringer and the second lineal engagement stringer sandwich the lineal stringer, the second lineal stringer, and the third lineal stringer.

Clause 8. The pallet assembly of clause 6, further comprising a plurality of mechanical fasteners for traversing the main wall of the lineal slat and engaging with the internal screw boss of the lineal stringer, to securably fasten the lineal slat to the lineal stringer.

Clause 9. The pallet assembly of clause 6, wherein the lineal engagement stringer further comprises a target insert.

Clause 10. The pallet assembly of clause 6, wherein the lineal stringer further comprises a target insert.

Clause 11. The pallet assembly of clause 10, further comprising a plurality of mechanical fasteners for engaging with the internal screw boss of the lineal stringer, to securably fasten the target insert to the lineal stringer.

Clause 12. A pallet assembly, comprising: (i) a lineal engagement stringer having a profile, the profile comprising an internal space, a profile wall at least partially defining the internal space; (ii) a lineal stringer having a first end, a second end, a top wall, and an internal screw boss, the top wall of the lineal stringer defining a plurality of slots; (iii) a lineal slat having a main wall and a leg, a portion of the leg configured to fit into a slot of the plurality of slots of the lineal stringer, and a portion of the main wall configured to sit on a portion of the top wall when the leg is pressed into the slot of the lineal stringer; and (iv) a mechanical fastener for traversing the profile wall of the lineal engagement stringer and engaging with the internal screw boss of the lineal stringer, to securably fasten the first end of the lineal stringer to the lineal engagement stringer.

Clause 13. The pallet assembly of clause 12, wherein the lineal stringer further comprises a target insert and a plurality of mechanical fasteners for engaging with the internal screw boss of the lineal stringer, to securably fasten the target insert to the lineal stringer.

Clause 14. The pallet assembly of clause 12, further comprising a second lineal engagement stringer and a second mechanical fastener for securably fastening the second end of the lineal stringer to the second lineal engagement stringer.

Clause 15. The pallet assembly of clause 12, further comprising a second lineal stringer and a third lineal stringer; wherein a second portion of the leg of the lineal slat is configured to fit into a slot of a plurality of slots of the second lineal stringer, a second portion of the main wall of the lineal slat configured to sit on a second portion of the top wall of the second lineal stringer when the leg is pressed into the slot of the lineal stringer and the leg is pressed into the slot of the second lineal stringer; and wherein a third portion of the leg of the lineal slat is configured to fit into a slot of a plurality of slots of the third lineal stringer, a third portion of the main wall configured to sit on a third portion of the top wall of the third lineal stringer when the leg is pressed into the slot of the lineal stringer and the leg is pressed into the slot of the second lineal stringer and the leg is pressed into the slot of the third lineal stringer.

Clause 16. The pallet assembly of clause 12, further comprising: a second lineal engagement stringer; a second lineal stringer and a third lineal stringer; a second mechanical fastener for securably fastening the second end of the lineal stringer to the second lineal engagement stringer; a third mechanical fastener for securably fastening the second end of the second lineal stringer to the second lineal engagement stringer; and a third mechanical fastener for securably fastening the second end of the third lineal stringer to the second lineal engagement stringer, wherein a second portion of the leg of the lineal slat is configured to fit into a slot of a plurality of slots of the second lineal stringer, a second portion of the main wall of the lineal slat configured to sit on a second portion of the top wall of the second lineal stringer when the leg is pressed into the slot of the lineal stringer and the leg is pressed into the slot of the second lineal stringer, and wherein a third portion of the leg of the lineal slat is configured to fit into a slot of a plurality of slots of the third lineal stringer, a third portion of the main wall configured to sit on a third portion of the top wall of the third lineal stringer when the leg is pressed into the slot of the lineal stringer and the leg is pressed into the slot of the second lineal stringer and the leg is pressed into the slot of the third lineal stringer.

Clause 17. The pallet assembly of clause 16, wherein the lineal engagement stringer and the second lineal engagement stringer sandwich the lineal stringer, the second lineal stringer, and the third lineal stringer.

Clause 18. The pallet assembly of clause 16, further comprising a plurality of mechanical fasteners for traversing the main wall of the lineal slat and engaging with the internal screw boss of the lineal stringer, to securably fasten the lineal slat to the lineal stringer.

Clause 19. A method of assembling a pallet assembly, the method comprising: (i) providing a lineal engagement stringer having a profile, the profile comprising an internal space and a profile wall at least partially defining the internal space; (ii) providing a lineal stringer having a first end, a second end, a top wall, an internal screw boss, and a target insert, the top wall of the lineal stringer defining a plurality of slots; (iii) providing a lineal slat having a main wall and a leg, a portion of the leg configured to fit into a slot of the plurality of slots of the lineal stringer, a portion of the main wall configured to sit on a portion of the top wall when the leg is pressed into the slot of the lineal stringer; and (iv) providing a screw for traversing the profile wall of the lineal engagement stringer and engaging with the internal screw boss of the lineal stringer, to securably fasten the first end of the lineal stringer to the lineal engagement stringer.

Clause 20. The method of clause 19, further comprising assembling the pallet by securably fastening the first end of the lineal stringer to the lineal engagement stringer and pressing the leg of the lineal slat into the slot of the lineal stringer such that the portion of the main wall of the lineal slat sits on the portion of the top wall of the lineal stringer.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A pallet assembly, comprising:

(i) a lineal engagement stringer having a profile, the profile comprising an internal space and a profile wall at least partially defining the internal space;

(ii) a lineal stringer having a first end, a second end, a top wall, and an internal screw boss, the top wall of the lineal stringer defining a plurality of slots;

(iii) a lineal slat having a main wall and a leg, a portion of the leg configured to fit into a slot of the plurality of slots of the lineal stringer, a portion of the main wall configured to sit on a portion of the top wall when the leg is pressed into the slot of the lineal stringer; and (iv) a mechanical fastener securably fastening the first end of the lineal stringer to the lineal engagement stringer, the mechanical fastener engaging the internal screw boss.

2. The pallet assembly of claim 1, wherein each slot of the plurality of slots of the lineal stringer corresponds to an individual lineal slat.

3. The pallet assembly of claim 1, wherein each pair of slots of the plurality of slots of the lineal stringer corresponds to an individual lineal slat.

4. The pallet assembly of claim 1, further comprising a second lineal engagement stringer and a second mechanical fastener for securably fastening the second end of the lineal stringer to the second lineal engagement stringer.

5. The pallet assembly of claim 1, further comprising a second lineal stringer and a third lineal stringer;

wherein a second portion of the leg of the lineal slat is configured to fit into a slot of a plurality of slots of the second lineal stringer, a second portion of the main wall of the lineal slat configured to sit on a second portion of the top wall of the second lineal stringer when the leg is pressed into the slot of the lineal stringer and the leg is pressed into the slot of the second lineal stringer; and wherein a third portion of the leg of the lineal slat is configured to fit into a slot of a plurality of slots of the third lineal stringer, a third portion of the main wall configured to sit on a third portion of the top wall of the third lineal stringer when the leg is pressed into the slot of the lineal stringer and the leg is pressed into the slot of the second lineal stringer and the leg is pressed into the slot of the third lineal stringer.

6. The pallet assembly of claim 1, further comprising:
a second lineal engagement stringer;
a second lineal stringer and a third lineal stringer;
a second mechanical fastener for securably fastening the second end of the lineal stringer to the second lineal engagement stringer;
a third mechanical fastener for securably fastening the second end of the second lineal stringer to the second lineal engagement stringer; and
a third mechanical fastener for securably fastening the second end of the third lineal stringer to the second lineal engagement stringer,
wherein a second portion of the leg of the lineal slat is configured to fit into a slot of a plurality of slots of the second lineal stringer, a second portion of the main wall of the lineal slat configured to sit on a second portion of the top wall of the second lineal stringer when the leg is pressed into the slot of the lineal stringer and the leg is pressed into the slot of the second lineal stringer, and
wherein a third portion of the leg of the lineal slat is configured to fit into a slot of a plurality of slots of the third lineal stringer, a third portion of the main wall configured to sit on a third portion of the top wall of the third lineal stringer when the leg is pressed into the slot of the lineal stringer and the leg is pressed into the slot of the second lineal stringer and the leg is pressed into the slot of the third lineal stringer.

7. The pallet assembly of claim 6, wherein the lineal engagement stringer and the second lineal engagement stringer sandwich the lineal stringer, the second lineal stringer, and the third lineal stringer.

8. The pallet assembly of claim 6, further comprising a plurality of mechanical fasteners for traversing the main wall of the lineal slat and engaging with the internal screw boss of the lineal stringer, to securably fasten the lineal slat to the lineal stringer.

9. The pallet assembly of claim 6, wherein the lineal engagement stringer further comprises a target insert.

10. The pallet assembly of claim 6, wherein the lineal stringer further comprises a target insert.

11. The pallet assembly of claim 10, further comprising a plurality of mechanical fasteners for engaging with the internal screw boss of the lineal stringer, to securably fasten the target insert to the lineal stringer.

12. A method of assembling a pallet assembly, the method comprising:
(i) providing a lineal engagement stringer having a profile, the profile comprising an internal space and a profile wall at least partially defining the internal space;
(ii) providing a lineal stringer having a first end, a second end, a top wall, an internal screw boss, and a target insert, the top wall of the lineal stringer defining a plurality of slots;
(iii) providing a lineal slat having a main wall and a leg, a portion of the leg configured to fit into a slot of the plurality of slots of the lineal stringer, a portion of the main wall configured to sit on a portion of the top wall when the leg is pressed into the slot of the lineal stringer; and
(iv) providing a screw for traversing the profile wall of the lineal engagement stringer and engaging with the internal screw boss of the lineal stringer, to securably fasten the first end of the lineal stringer to the lineal engagement stringer.

13. The method of claim 12, further comprising assembling the pallet by securably fastening the first end of the lineal stringer to the lineal engagement stringer and pressing the leg of the lineal slat into the slot of the lineal stringer such that the portion of the main wall of the lineal slat sits on the portion of the top wall of the lineal stringer.

* * * * *